US007533679B2

(12) United States Patent
Harbaugh

(10) Patent No.: US 7,533,679 B2
(45) Date of Patent: May 19, 2009

(54) COVERING WITH RIB LIGHTING ARRANGEMENT

(76) Inventor: Kenneth A. Harbaugh, 1000 Overlook Dr., Villa Rica, GA (US) 30180

( * ) Notice: Subject to any disclaimer, the term of this patent is extended or adjusted under 35 U.S.C. 154(b) by 402 days.

(21) Appl. No.: 11/381,070

(22) Filed: May 1, 2006

(65) Prior Publication Data

US 2007/0074750 A1 Apr. 5, 2007

Related U.S. Application Data

(63) Continuation-in-part of application No. 11/241,889, filed on Sep. 30, 2005.

(51) Int. Cl.
*A45B 3/02* (2006.01)

(52) U.S. Cl. ..... 135/16; 135/31; 135/910; 362/102

(58) Field of Classification Search ..... 135/29, 135/31, 910; 362/102, 652, 653, 654, 655, 362/656
See application file for complete search history.

(56) References Cited

U.S. PATENT DOCUMENTS

| | | | | |
|---|---|---|---|---|
| 2,960,094 | A | 11/1960 | Small | |
| 4,920,897 | A | 5/1990 | Reed et al. | |
| 5,053,931 | A | 10/1991 | Rushing | |
| 5,055,984 | A | 10/1991 | Hung et al. | |
| 5,126,922 | A | 6/1992 | Andreasen | |
| 5,172,711 | A | 12/1992 | Mueller et al. | |
| 5,192,127 | A * | 3/1993 | Schaef | 362/655 |
| 5,273,062 | A | 12/1993 | Mozdzanowski | |
| 5,349,975 | A | 9/1994 | Valdner | |
| 5,463,536 | A | 10/1995 | Chou et al. | |
| 5,584,564 | A | 12/1996 | Phyle | |
| 5,611,614 | A | 3/1997 | Morgan | |
| 5,664,874 | A | 9/1997 | Winterer | |
| 5,758,948 | A | 6/1998 | Hale | |
| 5,911,493 | A | 6/1999 | Walker et al. | |
| 6,017,188 | A | 1/2000 | Benton | |
| 6,058,951 | A | 5/2000 | Wilson | |
| 6,059,430 | A * | 5/2000 | Chen | 362/353 |
| 6,089,727 | A | 7/2000 | Wu | |
| 6,126,293 | A | 10/2000 | Wu | |

(Continued)

FOREIGN PATENT DOCUMENTS

| | | |
|---|---|---|
| JP | 9168415 | 6/1997 |

(Continued)

OTHER PUBLICATIONS

U.S. Appl. No. 10/829,790, filed Apr. 22, 2004, Kuelbs, Gregory.

(Continued)

*Primary Examiner*—David Dunn
*Assistant Examiner*—Danielle Jackson
(74) *Attorney, Agent, or Firm*—Kilpatrick Stockton LLP

(57) ABSTRACT

A rib for a covering with a light source, bulb holder, and globe is disclosed. In one embodiment, the rib comprises a bulb holder configured to secure a light source and includes structure in order to be installed into the rib and allow for a globe device to be attached to the bulb holder in order to protect the light source and for decorative purposes.

8 Claims, 7 Drawing Sheets

U.S. PATENT DOCUMENTS

| | | | | |
|---|---|---|---|---|
| 6,182,917 | B1 | 2/2001 | Lai | |
| 6,270,230 | B1 | 8/2001 | Mai | |
| 6,298,866 | B1 | 10/2001 | Molnar, IV | |
| 6,299,325 | B1 | 10/2001 | Cathel | |
| 6,341,873 | B1 | 1/2002 | Yang | |
| 6,406,163 | B1 | 6/2002 | Yang | |
| 6,439,249 | B1 | 8/2002 | Pan et al. | |
| 6,499,856 | B2 | 12/2002 | Lee | |
| 6,598,990 | B2 | 7/2003 | Li | |
| 6,612,713 | B1 | 9/2003 | Kuelbs | |
| 6,666,224 | B2 | 12/2003 | Lee | |
| 6,692,135 | B2 | 2/2004 | Li | |
| 6,729,742 | B2 | 5/2004 | Wismeth et al. | |
| 6,837,255 | B2 | 1/2005 | Bunch et al. | |
| 6,923,194 | B2 | 8/2005 | Li | |
| 6,966,667 | B2 | 11/2005 | Li | |
| 6,974,354 | B2 * | 12/2005 | Wu | 439/699.2 |
| 7,013,903 | B2 | 3/2006 | Li | |
| 7,108,388 | B2 | 9/2006 | Li | |
| 2002/0078985 | A1 | 6/2002 | Farr | |
| 2003/0084931 | A1 | 5/2003 | Lee | |
| 2004/0031510 | A1 | 2/2004 | Li | |
| 2004/0149325 | A1 | 8/2004 | Kuelbs | |
| 2005/0072451 | A1 | 4/2005 | Vivian et al. | |
| 2005/0155636 | A1 | 7/2005 | Lee | |
| 2006/0005869 | A1 | 1/2006 | Kuelbs | |
| 2007/0074750 | A1 | 4/2007 | Harbaugh | |

FOREIGN PATENT DOCUMENTS

| | | |
|---|---|---|
| WO | WO93/00840 | 1/1993 |

OTHER PUBLICATIONS

U.S. Appl. No. 60/335,933, filed Nov. 2, 2001, Kuelbs, Gregory.
U.S. Appl. No. 60/267,018, filed Feb. 7, 2001, Kuelbs, Gregory.
Kuelbs, Gregory, G., Second Declaration Under 37C.F.R. §1.131 and Exhibits; Reexamination of Patent No. 6612713; submitted Jan. 29, 2007.
U.S. Appl. No. 11/241,889, filed Apr. 5, 2007, Joseph Fraser.

* cited by examiner

COVERING WITH RIB LIGHTING ARRANGEMENT

CROSS REFERENCE TO RELATED APPLICATIONS

This application is a continuation-in-part of U.S. patent application Ser. No. 11/241,889 entitled "Umbrella Having Structural Rib Configured to Receive Electrical Components and Associated Wiring" filed on Sep. 30, 2005.

FIELD OF THE INVENTION

This invention relates generally to umbrellas, gazebos and the like, and more particularly to a rib for such a structure that incorporates a light bulb holder.

BACKGROUND OF THE INVENTION

Coverings such as large, patio-style umbrellas and gazebos are useful on patios, decks, pools, beaches, yards, parks, and other settings for providing protection from the sun or other weather conditions and allowing users a convenient way to enjoy cover while participating in outdoor activities. In addition to providing shade during daytime activities, such coverings can also serve as a focal point for evening activities. For activities after dark, it is desirable for the covering to incorporate some type of lighting.

Conventional lighting for coverings such as umbrellas and gazebos is often attached to the outside surface of a support member or rib structure and includes unsightly exposed connectors and wires. It would therefore be desirable to provide an arrangement by which the electrical components of the lighting system are largely hidden from view. It would further be desirable for such an arrangement to be easy to install and to service.

SUMMARY

Stated generally, the present invention relates to a covering with lights mounted to a rib. The lighting arrangement comprises a rib that includes a bulb holder for securing a light bulb. The bulb holder includes resilient arms at its upper end that clip under the upper walls of the rib to retain the bulb holder in place within the rib. The bulb holder further comprises an outwardly extending protrusion. A globe includes an elongated portion extending upward from the globe and a ridge extending inward from the elongated portion. The ridge engages the protrusion on the bulb holder to attach the globe to the bulb holder.

According to one embodiment of the present invention, a rib for a covering comprises a bottom wall, a top wall, first and second side walls extending upwards from the bottom wall to the top wall, and an intermediate wall extending between the first and second side walls at a location intermediate to the bottom wall and top wall. A longitudinal slot is formed in the upper rib wall. The rib further comprises a first hole extending through the intermediate wall and a second hole extending through the bottom wall generally in alignment with the first hole. A bulb holder extends through the first hole and second hole and is adapted to secure a light source. A protrusion extends outward from the bulb holder, and an arm portion extends upward from the bulb holder to the top wall.

According to another embodiment of the present invention, a globe is configured to guard against damage to the light source.

According to another embodiment of the present invention, the elongated portion of the globe comprises a groove extending along at least one side of the elongated portion.

According to another embodiment of the present invention, the covering is an umbrella.

According to another embodiment of the present invention, the covering is a gazebo.

According to another embodiment of the present invention, the arm portion of the bulb holder comprises outwardly extending flanges.

According to another embodiment of the present invention, the arm portion of the bulb holder comprises beveled surfaces on the outer edges of the outwardly extending flanges.

According to another embodiment of the present invention, the arm portion is configured to retain the bulb holder beneath the top wall.

Other objects, features, and advantages of the present invention will become apparent upon reading the following specification, when taken in conjunction with the drawings and the appended claims.

DETAILED DESCRIPTION

Figure 1:
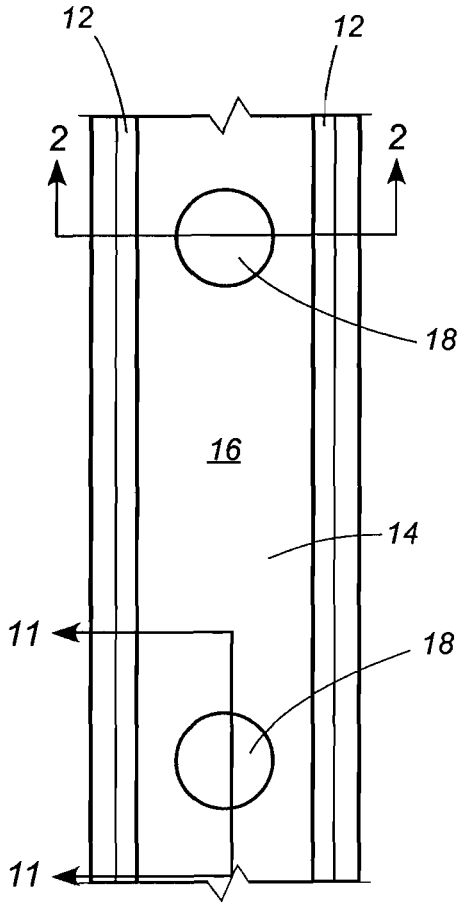
FIG. 1 is a top view of a section of a rib of a covering such as an umbrella or gazebo according to a disclosed embodiment of the present invention.
Figure 2:
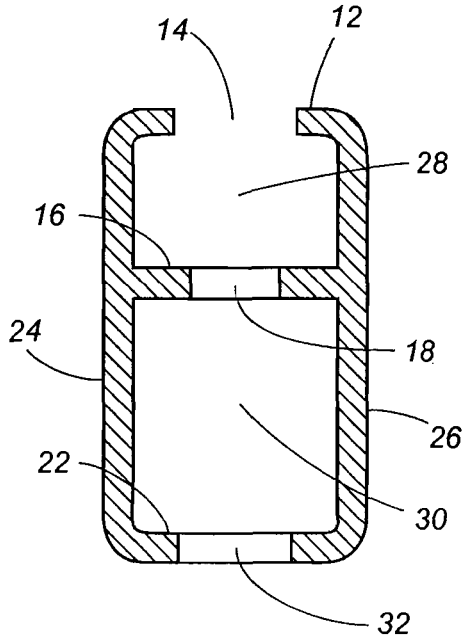
FIG. 2 is a cutaway view taken along line 2-2 of FIG. 1.

FIGS. 1 and 2 illustrate a rib 10 for use on a covering such as a large, patio-style umbrella or gazebo. The rib 10 includes a top wall 12 that has a longitudinal slot 14 extending along the length of the rib. Below the top wall 12 and opening 14 is an intermediate wall 16 that includes holes 18 formed therethrough. The rib 10 includes a bottom wall 22 and two side walls 24, 26 extending between the top wall 12 and bottom wall 22. The intermediate wall 16 forms two channels 28, 30 with the top wall 12 and bottom wall 18 respectively. The bottom wall 22 has holes 32 formed therethrough in coaxial alignment with the holes 18 in the intermediate wall 16.

Figure 3:
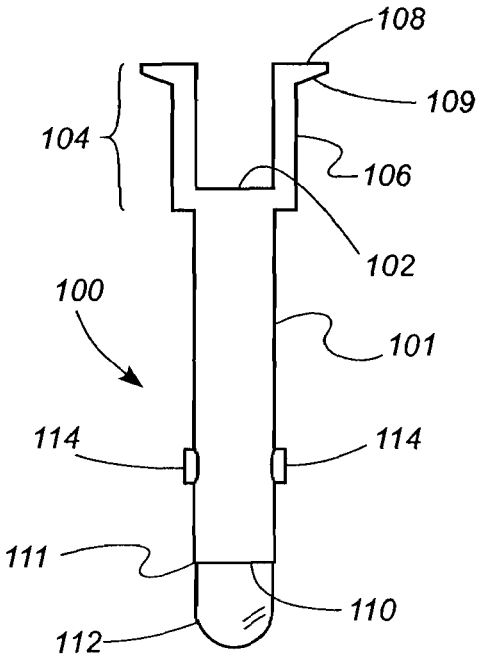
FIG. 3 is a front view of a bulb holder for use with the rib of FIG. 1.
Figure 4:
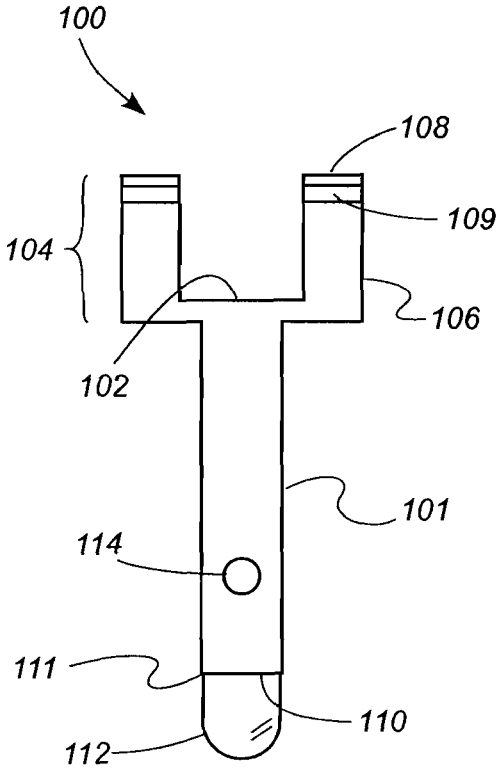
FIG. 4 is a side view of the bulb holder of FIG. 3.
Figure 5:
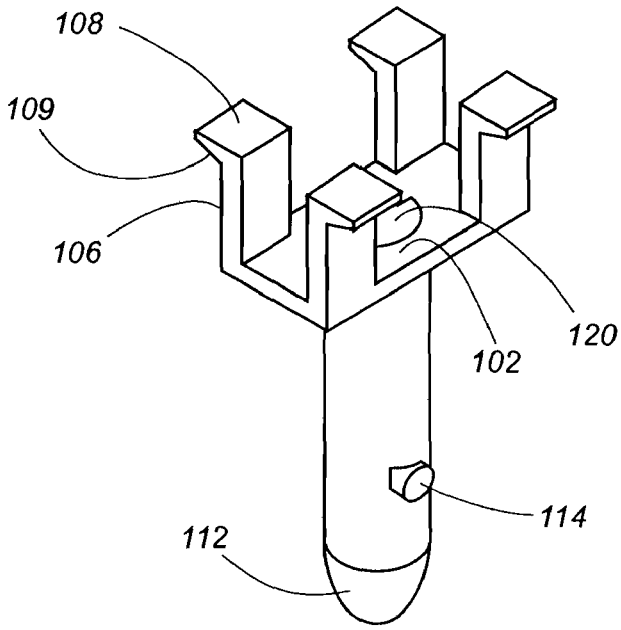
FIG. 5 is an isometric view of the bulb holder of FIG. 3.

FIGS. 3-5 illustrate a bulb holder 100 to be installed in the rib 10 to secure a light source such as an incandescent bulb, LED, or other suitable light source. The bulb holder 100 includes a cylindrical body portion 101 having a first end 102. A resiliently deformable head portion 104 extends from the first end 102. As illustrated, the head portion 104 includes a plurality of legs 106, each having a flange 108 that extends outwardly with respect to the associated leg 106. The lower outer edge 109 of each flange 108 is beveled. The resiliently deformable portion 104 may be made of any material that is at least partially bendable under a force and returns to an original position once the force is removed. Such material may include, for example, rubber or plastic.

The bulb holder 100 includes a bulb receptacle 110 at a second end 111 of the bulb holder. The bulb receptacle 110 is able to receive and hold a light source 112. Two protrusions 114 extend outwardly with respect to the bulb holder 100 and, as described in more detail below, detachably engage a globe in order to protect the light source 112 and provide easy access to the light source.

As illustrated in FIG. 5, the bulb holder 100 includes an opening 120 at the upper end 102 of the body portion 101. Wires from a power source are inserted and connected to the light source through the opening 120.

Figure 6:
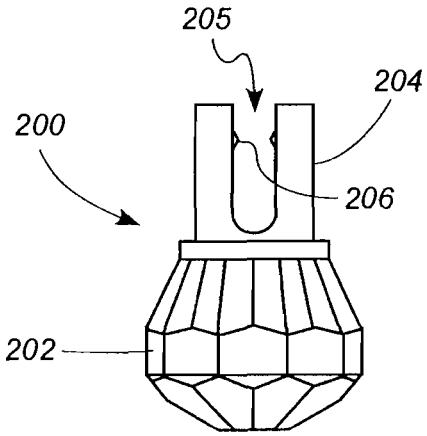
FIG. 6 is a side view of a globe for use with the bulb holder of FIGS. 3-5.
Figure 7:
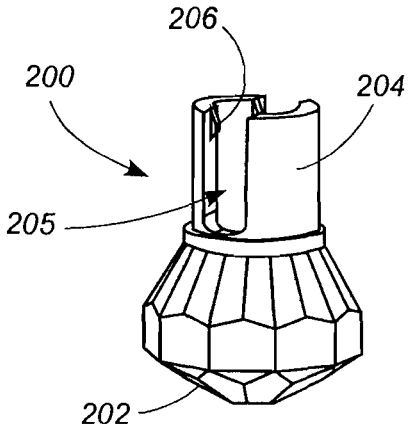
FIG. 7 is a perspective view of the globe of FIG. 6.

FIGS. 6 and 7 illustrate a globe 200 that is connectable to the bulb holder 100. The globe 200 includes a globe portion 202 to protect a light source when the globe 200 is connected to the bulb holder 100 and assist in directing the light from the light source for illumination purposes. An elongated portion 204 extends upward from the globe portion 202. A pair of longitudinal grooves 205 extend downward from the upper end of the elongated portion 204. Ridges 206 extend inwardly from opposite walls of the longitudinal grooves 205. The ridges engage the bulb holder protrusions 114 when the globe 200 is connected to the bulb holder 100. The elongated portion 204 may be made of a resilient material. The elongated portion 204 bends outward slightly to allow the ridges 206 to be fitted around the protrusions 114, 116. When the ridges 206 are around the prostrusion 114, 116, the elongated portion 204 returns to its original position.

Figure 8:
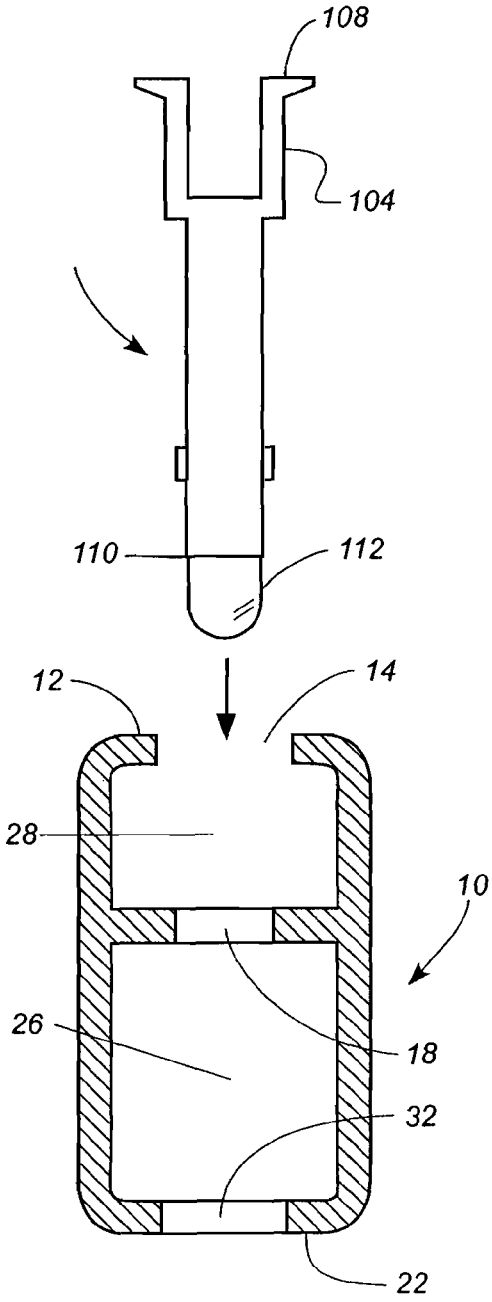
FIG. 8 is a cross-sectional view taken along line 2-2 of FIG. 1 showing a first step in the assembly of the bulb holder of FIGS. 3-5 onto the rib of FIGS. 1 and 2.
Figure 9:
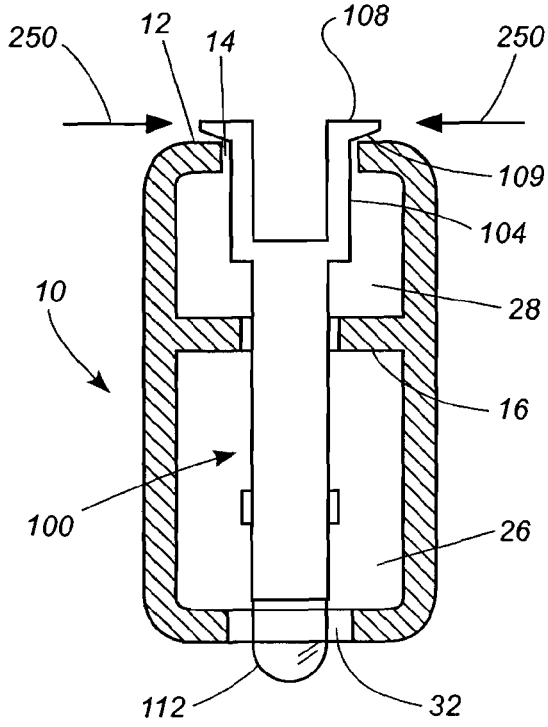
FIG. 9 is a cross-sectional view of the rib and bulb holder of FIG. 8 showing a second step in the assembly of the bulb holder onto the rib.
Figure 10:
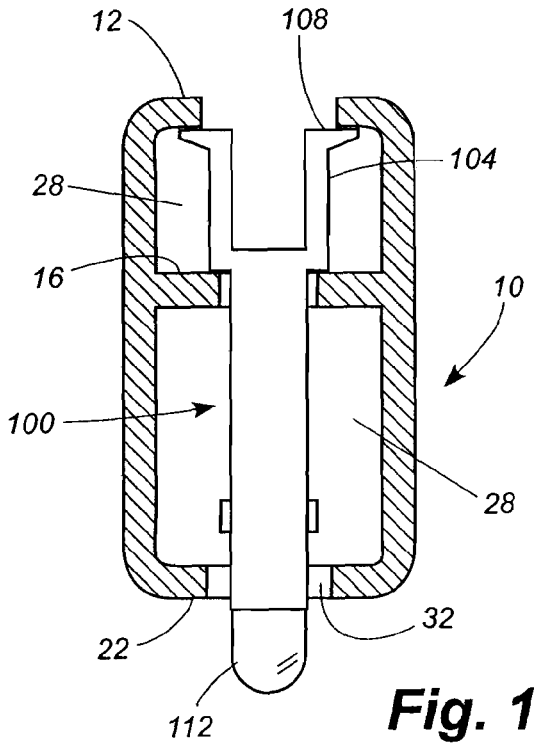
FIG. 10 is a cross-sectional view of the rib and bulb holder of FIG. 8 showing a third step in the assembly of the bulb holder onto the rib.

FIGS. 8-10 illustrate the assembly of the bulb holder 100 of FIGS. 3-5 into the rib 10 of FIGS. 1 and 2. To install the bulb holder 100 into the rib 10, the lower end of the bulb holder 100 is directed through the top wall opening 14. The bulb holder 100 is then inserted through the upper channel 28, the hole 18 in the intermediate wall 16, the lower channel 30, and the hole 32 in the bottom wall 22 until the resilient deformable portion flanges 108 confront the top wall 12. The flanges 108 are pushed inward, as indicated by the arrows, to a position in which the flanges can pass through the top wall opening 14 and into the channel 28.

As illustrated in FIG. 10, once the resilient deformable flanges 108 clear the top wall 12 of the rib 10, they return to their original position. After installation, the resilient deformable flanges 108 are captured underneath the top wall 12 to prevent the bulb holder 100 from becoming accidentally detached from the rib 10. Furthermore, the resilient deformable portion 104 communicates with the intermediate wall 16 to prevent the bulb holder 100 from becoming accidentally detached from the rib 10. In addition, the light source 112 protrudes slightly out of the hole 32 in the bottom wall 22.

Figure 11:
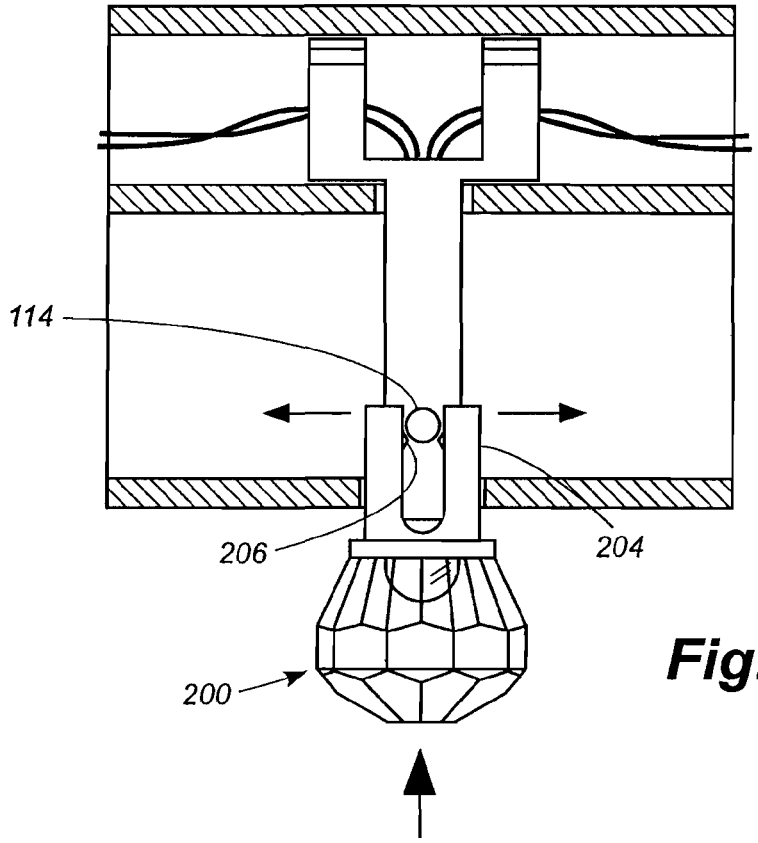
FIG. 11 is a cross-sectional view taken along line 11-11 of FIG. 1 showing a first step in the assembly of the globe of FIGS. 6 and 7 onto the bulb holder of FIGS. 3-5.
Figure 12:
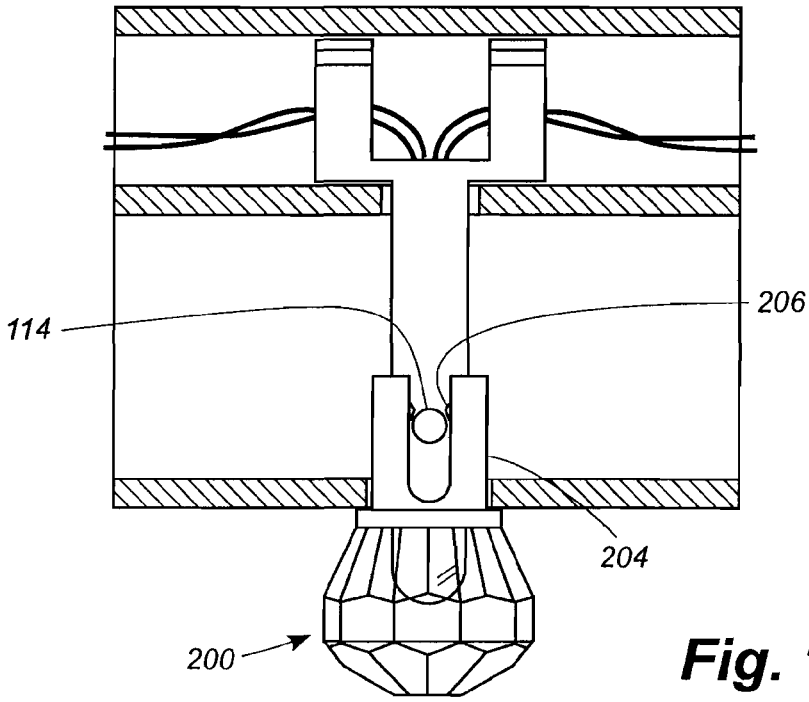
FIG. 12 is a cross-sectional view of the globe and bulb holder of FIG. 11 showing a second step in the assembly of the globe onto the bulb holder.

FIGS. 11 and 12 show the assembly of the globe 200 of FIGS. 6 and 7 onto the bulb holder 100 of FIGS. 3-5. The globe 200 is installed by first directing the globe 200 upward through the hole 32 in the rib bottom wall 22 and around the light source 112. The globe elongated portion 204 is bent outward as indicated by the arrows, until the ridges 206, 208 clear the bulb holder protrusions 114, 116. As shown in FIG. 12, once the ridges 206, 208 are located on the upward side of the protrusions 114, 116, the globe elongated portion 204 is released, and it returns to its original configuration. The ridges 206, 208 communicate with the protrusions 114, 116 to prevent the globe 200 from becoming accidentally detached from the bulb holder 100.

Figure 13:
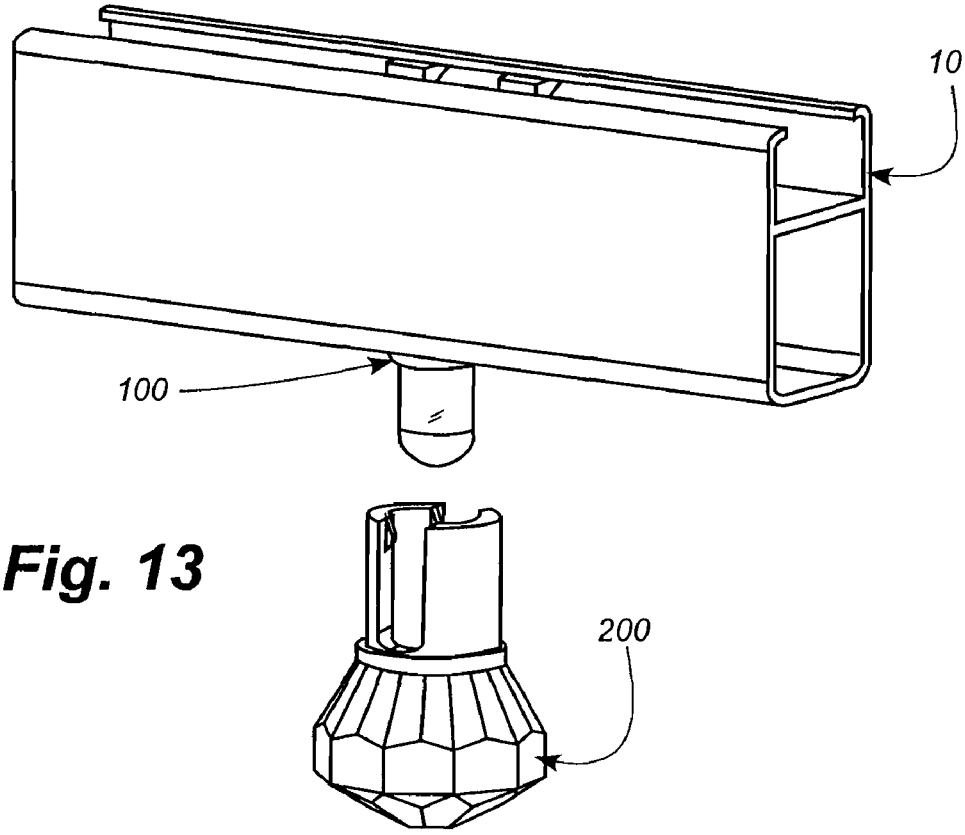
FIG. 13 is an isometric view of the rib section with the bulb holder assembled onto the rib and globe exploded from the bulb holder.
Figure 14:
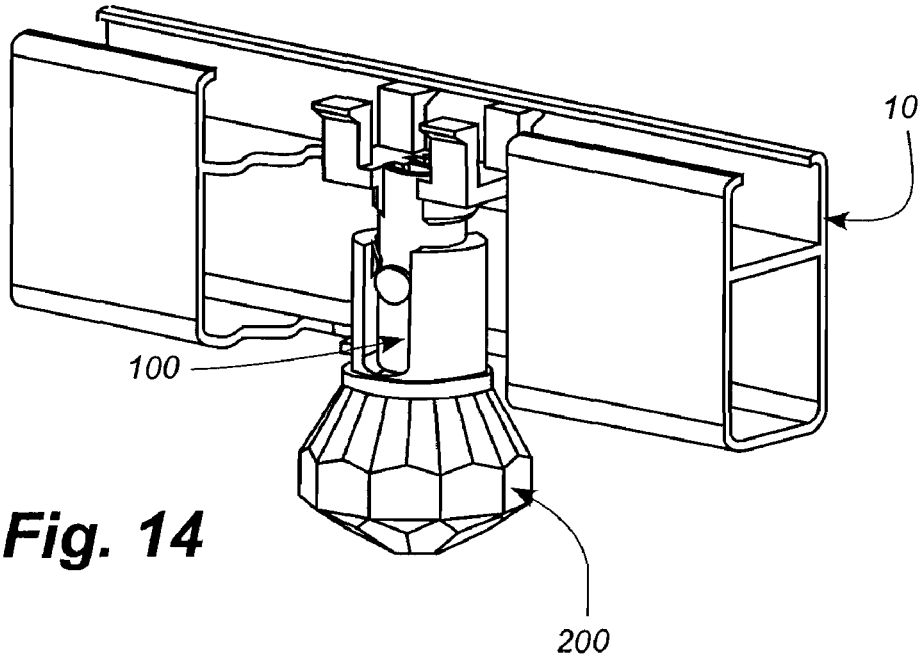
FIG. 14 is a partially cut-away view of the device of FIG. 13 with the globe attached to the bulb holder.

FIGS. 13 and 14 illustrate the globe 200 being assembled with the bulb holder 100 after the bulb holder 100 is installed in the rib 10. Specifically, FIG. 13 shows an isometric view of the rib section 10 with the bulb holder 100 assembled onto the rib 10 and globe 200 exploded from the bulb holder 100 while FIG. 14 shows a partially cut-away view of the rib 10 with bulb holder 100 installed and with the globe 200 attached to the bulb holder 100.

Figure 15:
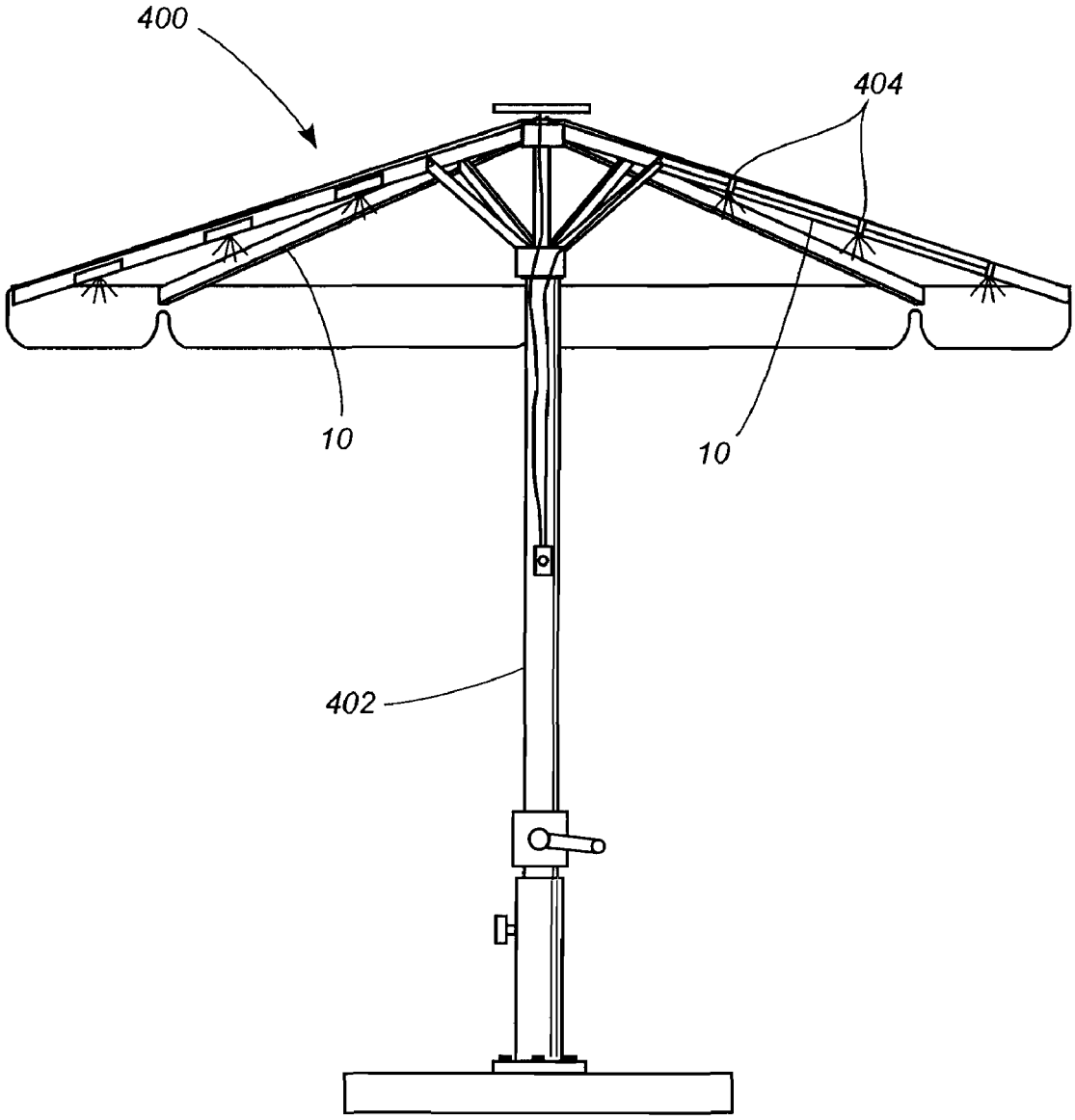
FIG. 15 is a side cutaway view of an umbrella with center mast having a lighting arrangement according to the present invention.
Figure 16:
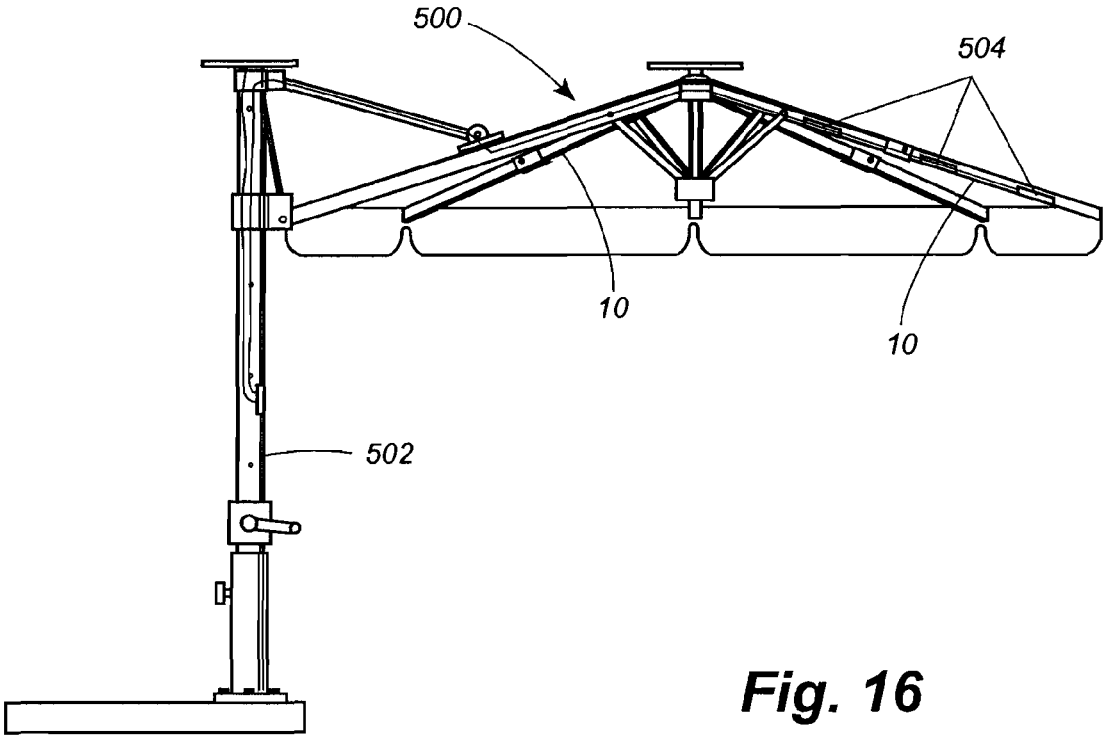
FIG. 16 is a side cutaway view of an umbrella with offset mast having a lighting arrangement according to the present invention.
Figure 17:
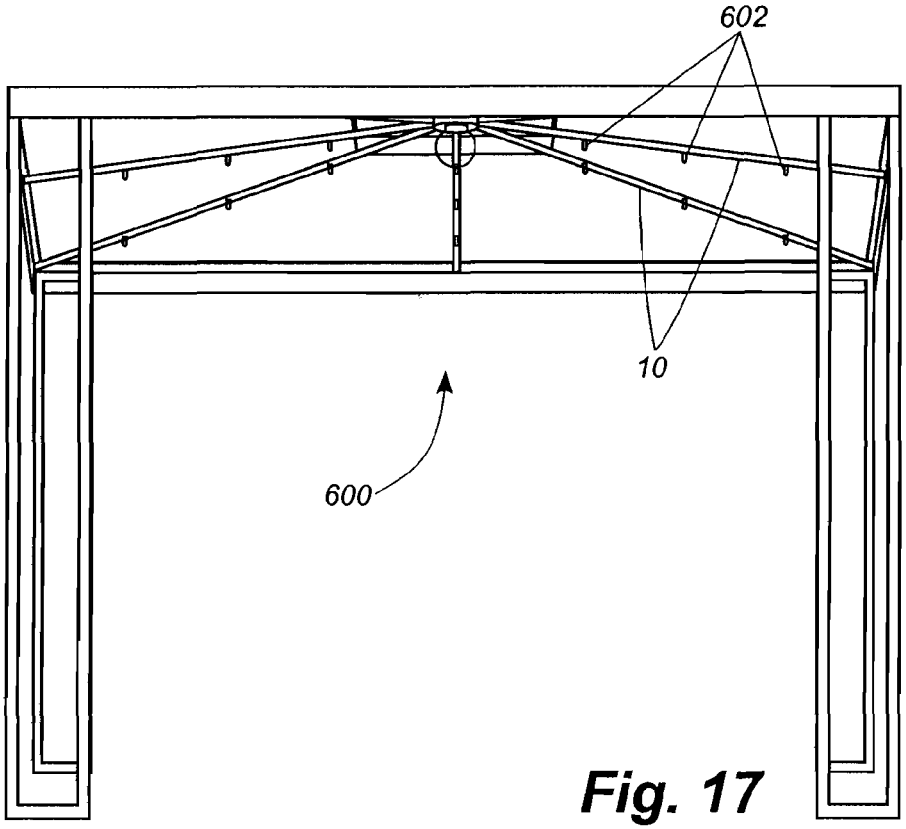
FIG. 17 is a perspective view of a gazebo having a lighting arrangement according to the present invention.

Referring now to FIGS. 15-17, illustrated are various types of coverings with ribs 10 in which the bulb holder 100 and globe 200 may be attached. Furthermore, FIGS. 15-17 show that the bulb holder 100 and globe 200 may be installed throughout the covering ribs 10 where the rib 10 includes any number of bulb holders 100 and globes 200. For example, FIG. 15 shows a cutaway view of an umbrella 400 with a center mast 402 and a rib lighting arrangement in which the lights 404 are spaced along the ribs 10. FIG. 16 shows an umbrella 500 with an offset mast 502. The umbrella has a lighting arrangement 504 along the ribs 10. FIG. 17 is a gazebo 600 having a lighting arrangement 602 along the gazebo ribs 10.

Unless otherwise stated, terms used herein such as "top," "bottom," "upper," "lower," "left," "right," "front," "back," and the like are used only for convenience of description and are not intended to limit the invention to any particular orientation.

While the above description contains many specifics, these specific embodiments should not be construed as limitations on the scope of the invention, but merely as examples of the disclosed embodiments. Those skilled in the art will envision many other possible variations that are within the scope of the invention.

What is claimed is:

1. An apparatus comprising:

a rib comprising, a bottom wall;

a top wall having a lower surface and having a longitudinal slot formed therethrough;

first and second side walls extending upwards from said bottom wall to said top wall; and an intermediate wall extending between the first and second side walls at a location intermediate to the bottom wall and top wall;

a first hole extending through said intermediate wall; and a second hole extending through said bottom wall generally in alignment with said first hole;

a bulb holder having a body portion, said body portion of said bulb holder extending through said first hole and said second hole in said rib and adapted to secure a light source; and laterally resilient flanges extending upward from said body portion of said bulb holder, said flanges being captured underneath and confronting the lower surface of said top wall to secure the bulb holder within the rib.

2. The apparatus of claim 1, wherein each of the flanges comprises a beveled surface.

3. The apparatus of claim 1, wherein said flanges are inwardly flexible to allow for insertion through said longitudinal slot in said upper wall of said rib and to resile outwardly after insertion.

4. The apparatus of claim 1, wherein said bulb holder comprises a protrusion extending outwardly from said body portion, and wherein said apparatus further comprises:

a globe;

an elongated portion extending upwardly from said globe, the elongated portion comprising an opening extending from the top of said elongated portion and downward along at least one side of the elongated portion; and a ridge extending from said elongated portion into the opening and positioned to engage said protrusion for detachably attaching said globe to said bulb holder.

5. A covering comprising a plurality of ribs and a canopy, each rib comprising:

a bottom wall having a first hole formed therein;

a top wall having a lower surface and having a longitudinal slot formed therethrough;

first and second side walls extending upwards from said bottom wall to said top wall;

an intermediate wall extending between the first and second side walls at a location intermediate to said bottom wall and top wall, said intermediate wall having a second hole formed therethrough that is generally aligned with said first hole;

a bulb holder having a body portion, said body portion of said bulb holder extending through said first hole and said second hole in said rib and adapted to secure a light source; and laterally resilient flanges extending upward from said body portion of said bulb holder, said flanges being captured underneath and confronting the lower surface of said top wall to secure the bulb holder within the rib.

6. The covering of claim 5, wherein each of the flanges comprises a beveled surface.

7. The covering of claim 5, wherein said flanges are inwardly flexible to allow for installation through said longitudinal slot in said upper wall in said rib and to resile outwardly after installation.

8. The covering of claim 5, further comprising:

a globe;

an elongated portion extending upward from said globe, the elongated portion comprising an opening extending from a top of said elongated portion and downward along at least one side of the elongated portion; and a ridge extending from said elongated portion in the opening and positioned to engage said protrusion for detachably attaching said globe on said bulb holder by engaging said protrusion.

* * * * *